United States Patent [19]

Murakami et al.

[11] Patent Number: 4,577,603

[45] Date of Patent: Mar. 25, 1986

[54] DEVICE FOR CONTROLLING ENGINE RPM

[75] Inventors: Masanobu Murakami; Masaaki Miyazaki, both of Hyogo, Japan

[73] Assignee: Mitsubishi Denki Kabushiki Kaisha, Tokyo, Japan

[21] Appl. No.: 704,689

[22] Filed: Feb. 22, 1985

Related U.S. Application Data

[63] Continuation-in-part of Ser. No. 524,254, Aug. 18, 1983.

[30] Foreign Application Priority Data

Aug. 18, 1982 [JP] Japan ..... 57-144419
Aug. 18, 1982 [JP] Japan ..... 57-144429

[51] Int. Cl.[4] ..... F02D 11/10
[52] U.S. Cl. ..... 123/339; 290/40 A
[58] Field of Search ..... 123/339, 352; 290/40 R, 290/40 A, 40 B, 40 C, 51

[56] References Cited

U.S. PATENT DOCUMENTS 4,184,083 1/1980 Takeuchi ..... 123/339
4,438,744 3/1984 Hasegawa ..... 123/339
4,441,471 4/1984 Kratt ..... 123/339
4,467,761 8/1984 Hasegawa ..... 123/339
4,479,472 10/1984 Shimamura ..... 123/339
4,491,108 1/1985 Hasegawa ..... 123/339

*Primary Examiner*—Ronald B. Cox
*Attorney, Agent, or Firm*—Sughrue, Mion, Zinn, Macpeak, and Seas

[57] ABSTRACT

An engine RPM control device has a load compensator responsive to the engine load status setting for adding a load compensation signal to the output from a control signal computing unit, thereby enabling an actuator to open or close a throttle valve. The engine RPM is controlled through a feedback loop. A load driver is actuated to drive the engine load a time interval after the engine load status setting has been detected by a load switch. Therefore, the engine load is energized or de-energized after the engine RPM has been changed to meet the engine load status setting. Any reduction or increase in the engine RPM due to the change of the engine load is thus held to a minimum.

1 Claim, 11 Drawing Figures

FIG. 4
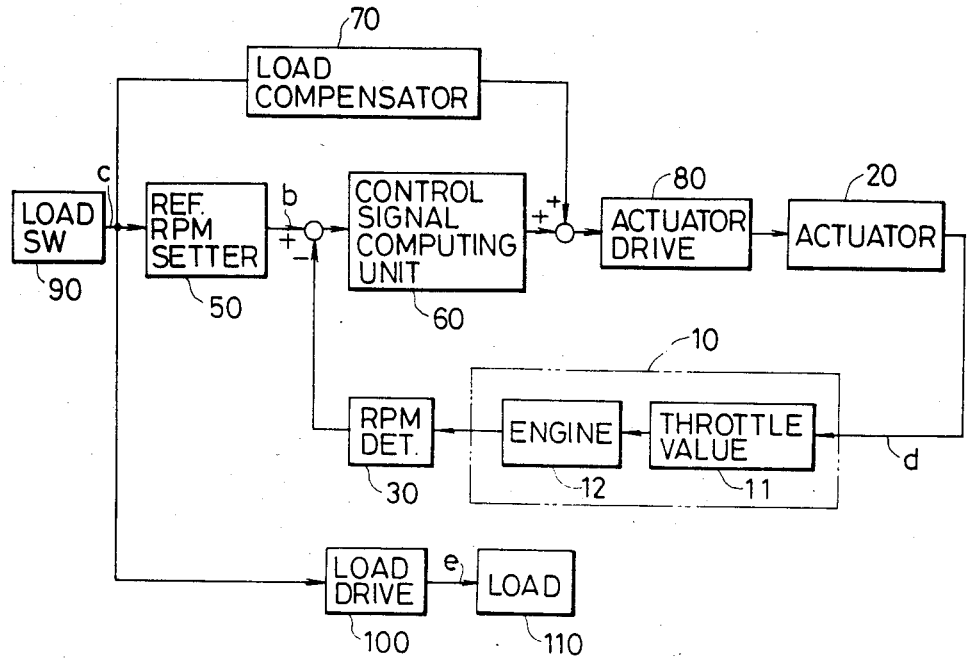
FIG. 5(a)
FIG. 5(b)
FIG. 5(c)
FIG. 5(d)
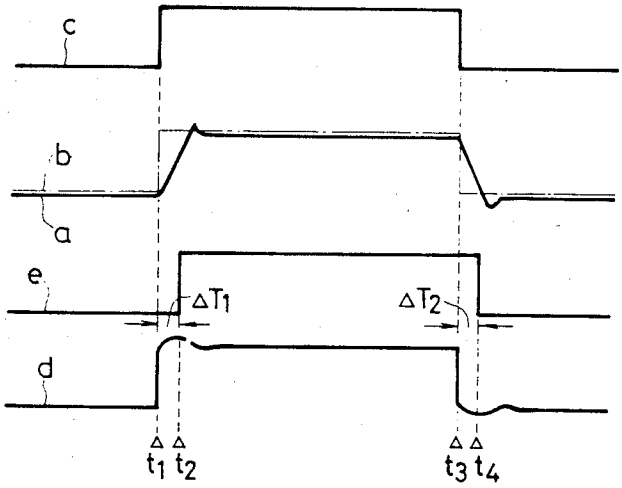

DEVICE FOR CONTROLLING ENGINE RPM

RELATED APPLICATIONS

This application is a continuation-in-part of application Ser. No. 524,254, filed Aug. 18, 1983, and now pending.

BACKGROUND OF THE INVENTION

The present invention relates to a device for controlling engine RPM through a feedback loop so as to equalize the same to a target or reference engine RPM established according to engine conditions.

With conventional engine RPM control devices, any change in the engine RPM due to an engine load torque variation, such as when the load status is shifted from the ON to the OFF condition or vice versa, is minimized under predictive control on direct detection of such a load status change. However, the actuator for controlling the throttle valve is subjected to a delay time in operation, and it takes a certain interval of time for the engine RPM to vary in response to any desired opening of the throttle valve. Therefore, any change in the engine RPM caused at the time of a variation in the load condition cannot be eliminated solely by predictive control. The prior control device is particularly disadvantageous in that the engine tends to be forcibly stopped when the engine load is shifted from the OFF status to the ON status with a large and abrupt torque variation.

SUMMARY OF THE INVENTION

With the foregoing problems in mind, it is an object of the present invention to provide an engine RPM control device capable of minimizing any change in engine RPM when the engine load is turned on or off.

According to the present invention, there is provided an engine RPM control device comprising means for setting a reference engine RPM, means for detecting engine RPM, means for computing a control signal based on the difference between the engine RPM detected by the detecting means and the reference engine RPM and for changing the engine RPM in response to the control signal, a load switch for detecting a load energization setting of a load de-energization setting for an engine load, a load compensator for adding a predetermined load compensation signal dependent on the load setting detected by the load switch, to the control signal, and drive means for turning the load or or off when the engine RPM reaches the vicinity of the new reference RPM set by altering the condition of the load switch. After engine RPM have been substantially equalized to the reference engine RPM through operation of the load compensator in response to detection by the load switch of the load energization setting or the load de-energization setting, the drive means is actuated to turn the load on or off.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 4 is a block diagram of a device for controlling engine RPM according to the present invention; and FIGS. 5(*a*)–5(*d*) are timing charts showing the operations of the device illustrated in FIG. 4.

DETAILED DESCRIPTION OF THE PREFERRED EMBODIMENT

Figure 1:
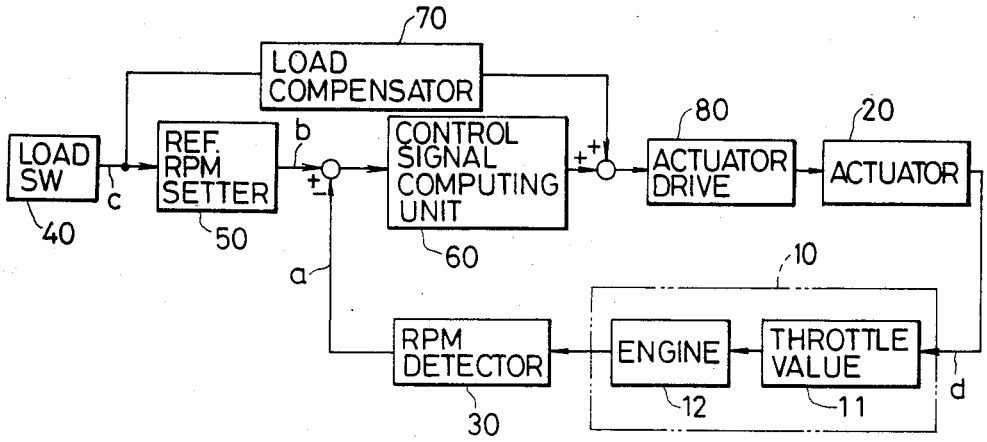
FIG. 1 PRIOR ART
FIG. 1 is a block diagram of a conventional device for controlling engine RPM.

FIG. 1 shows in block form a conventional device for controlling engine RPM. An internal combustion engine assembly 10 is composed of a throttle valve 11 and an engine 12. The throttle valve 11 is operated by a signal indicative of a throttle valve opening d issued from an actuator 20. The RPM of the engine 10 is detected by an RPM detector 30. A load detector switch 40 serves to determine whether an engine load such as an air conditioning unit is turned on or off. The load detector switch 40 issues an ON signal c when the engine load is turned on or energized, and an OFF signal c when the engine load is turned off or de-energized. A target or reference RPM setter 50 establishes a target or reference RPM dependent on the status of the load detector switch 40. A control signal computing unit 60 functions to compute a control or actuating signal from the difference between the actual RPM a of the engine 10 as detected by the RPM detector 30 and a reference RPM b determined by the reference RPM setter 30. A load compensator 70 issues a compensation signal dependent of the load in response to the condition of the load detector switch 40. An actuator driver 80 issues a drive signal to the actuator 20 in response to the sum of the output from the control signal computing unit 60 and the output from the load compensator 70.

Figure 2A:
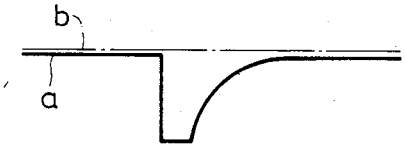
FIGS. 2(*a*)–2(*b*) and 3(*a*)–3(*c*) are timing charts illustrative of the operations of the device shown in FIG. 1.
Figure 2B:
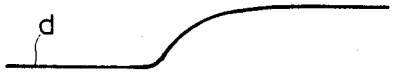

The operation of the prior control device thus constructed will be described with reference to FIGS. 2 and 3.

It is now assumed that the engine load (such as an automobile air conditioning unit) is in the OFF condition. When the engine load is in the OFF condition, the reference RPM setter 50 issues a predetermined reference engine RPM b. Suppose the actual engine RPM a is now reduced below the reference engine PRM b for some reason as shown in FIG. 2(*a*).

In response to the difference (b-a) produced as a result of such a sudden RPM drop, the control signal computing unit 60 computes and issues a control signal to the actuator driver 80. The actuator drive 80 is responsive to the supplied control signal to generate a drive signal thereby enabling the actuator 20 to open the throttle valve 11. As a consequence, the throttle valve opening d is increased as illustrated in FIG. 2(*b*). The actual engine RPM a now goes up as shown in FIG. 2(*a*) until it reaches the reference engine RPM b. Conversely, when the actual engine RPM a becomes higher than the reference engine RPM b for some reason, the actual engine RPM a is controlled so as to be brought into conformity with the reference engine RPM b by process similar to the above-mentioned.

It is now assumed that the load status as detected by the load detector switch 40 is switched between the ON condition and the OFF condition.

Figure 3A:
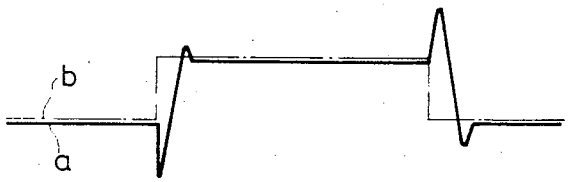
Figure 3B:
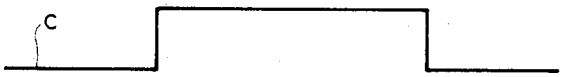
Figure 3C:
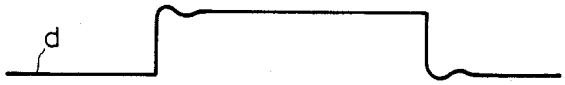

When the load condition is shifted from the OFF status to the ON status (as when the air conditioning unit is actuated), the load dectector switch 40 detects the load change and issues a positive-going load signal edge c indicative of this load change, as shown in FIG. 3(*b*). The reference engine RPM setter 50 is responsive to this load signal c for establishing a new reference engine RPM b as illustrated in FIG. 3(*a*). The load compensator 70 then generates a predetermined load compensation signal dependent on the load variation, the load compensation signal being added to the output from the control signal computing unit 60. As a result of this summing operation, the actuator driver 80 enables the actuator 20 to open the throttle valve 11 to thereby increase the throttle valve opening d as shown in FIG. 3(*c*). this load compensation does not rely on feedback control based on the engine RPM, but is effected under predictive control by which the throttle valve 11 is opened to a predetermined degree dependent on the magnitude of the engine load. This control mode can minimize the reduction in the engine RPM due to a load torque increase caused when the load is energized. The subsequent operation is the same as the foregoing operation in which the load status is in the OFF condition; the control signal computing unit 60 operates to bring the actual engine RPM a into conformity with the reference engine RPM b as shown in FIG. 3(*a*).

When the load status is shifted from the ON condition to the OFF condition (as when the air conditioning unit is de-energized), the load detector switch 40 detects the de-energization of the load and issues a negative-going load signal edge c as shown at the right in FIG. 3(*b*). The reference engine RPM setter 50 now establishes a new reference engine RPM b, and the load compensator 70 stops its adding operation.

The actuator 20 closes the throttle valve 11 to reduce the throttle opening d. This operation is based not on feedback control dependent on the engine RPM, but on predictive control dependent on the load variation, the process which is performed when the load status is changed from the OFF to the ON condition. Therefore, any increase in the engine RPM due to a reduction in the load torque can be held to a minimum. Thereafter, the control device operates in the same manner as that in which the load remains de-energized as described above.

With the conventional engine RPM control device, therefore, any change in the engine RPM due to a load torque variation such as when the load status is shifted from the ON to the OFF condition or vice versa is minimized under predictive control on direct detection of such a load status change. However, the actuator 20 is subjected to a delay time in operation, and it takes a certain interval of time for the engine RPM to vary in response to the desired opening d of the throttle valve 11. Therefore, any change in the engine RPM caused at the time of a variation in the load condition canot be eliminated solely by predictive control. The prior control device is particularly disadvantageous in that the engine tends to stall when the engine load is shifted from the OFF status to the ON status with a large torque variation.

The present invention will now be described with reference to FIGS. 4 and 5. Identical or corresponding parts in FIGS. 1-3 are denoted by identical or corresponding reference characters in FIGS. 4 and 5, and will not be described in detailed.

A load switch 90 in the control device of the present invention serves to detect whether the load setting is for the ON condition or the OFF condition, that is, whether the load status is set for the ON conditon or the OFF condition. The load, however, is not switched until a period of time after the load setting is switched. The period of time is sufficient to allow the engine RPM to reach substantially the RPM value set by the reference RPM setter. A load drive 100 detects changes in the load switch setting and then detects when the actual RPM is in the vicinity of the reference RPM and responds by altering the ON/OFF condition of the load.

The operation of the control device of the foregoing construction will be described with reference to FIGS. 5(*a*)-5(*d*).

If the status setting for the load 110 is shifted from the OFF condition to the ON condition at a time t1, then the load switch 90 detects such a setting change and generates a positive-going load signal edge c as shown in FIG. 5(*a*). In response to the output from the load switch 90, the reference engine RPM setter 50 establishes a reference engine RPM b dependent on the load setting as shown in FIG. 5(*b*). The load compensator 70 adds a predetermined load compensation signal dependent on the magnitude of the load 110 to an output from the control signal computing unit 60. The sum signal is then applied to the actuator driver 80 to enable the actuator 20 to open the throttle 11 to thereby increase the throttle valve opening d. As a result, the engine RPM is increased.

The load driver 100 detects when the engine rpm a reaches the reference rpm b at a time t2, and the load driver 100 issues a load drive signal e to drive the load 110 to the ON condition at the rise of the signal e. In this case, the throttle valve opening degree d is increased by a prediction control as shown in FIG. 5(*d*). Until the engine RPM a is increased as shown in FIG. 5(*b*), the load is not applied to the engine. There is no reduction in engine RPM. At the time t2 when the load 110 is actually energized, the throttle degree d has reached the reference value and the engine is subjected to the load around the reference RPM, substantially no reduction in the engine RPM due to the energization of the load is caused.

It is now assumed that the load status setting is shifted from the ON to the OFF condition.

The load switch 90 detects when the load setting is shifted from the ON condition to the OFF condition at a time t3 and issues a negative-going load signal edge c as illustrated on the right in FIG. 5(*a*). As a consequence, the reference engine RPM setter 50 changes the reference engine RPM b at the time t3 in response to the load condition as shown in FIG. 5(*b*). The load compensator 70 removes a load compensation signal (or adds a negative compensation signal) from the output of the control signal computing unit 60 such that the throttle valve 11 will be closed to meet the magnitude of the load decrease. The actuator driver 80 enables the actuator 20 to close the throttle valve 11 to thereby reduce the throttle valve opening d as shown in FIG. 5(*d*).

As a result, the engine RPM a is decreased as shown in FIG. 5(*b*). Subsequently, the load driver 100 detects that at the time t4, the engine RPM a is decreased to a value around the reference RPM b, and turns off the load 110 by reducing the load driver signal e as shown in FIG. 5(*c*). In this case, until the setting condition of the load is changed with the load compensation, and the engine RPM is reduced to about the reference RPM b, the load 110 is not turned off. Therefore, there is no unnecessary high speed operation of the engine due to the OFF operation of the load 110. Also, when the load 110 is turned off, the throttle valve opening degree d of the throttle valve 11 has essentially reached the throttle valve opening degree d which is the reference RPM b in case that the load 110 is turned off. Also, the load 110 is turned off around the reference RPM b. There is no change in engine RPM due to turning off the load 110. The operation except for the change of the set condition of the load 110 is the same as in the conventional system.

The foregoing embodiment of the invention is based on the assumption that the load varies while the engine is idling. Where the engine load is an automobile air conditioning unit, the engine RPM in an idling mode is in the range of from 700 to 750 rpm. The reference engine RPM is set in the range of from 900 to 1,000 rpm by turning on an air conditioning setting switch. The load may be turned on and off with an engine RPM change in the range of ±50 RPM of the reference engine RPM.

In the illustrated embodiment, the load 110 is energized and de-energized with the time delays $\Delta T1$ and $\Delta T2$ whenever the status setting for the load 110 is shifted from the OFF condition to the ON condition or vice versa. However, either energization or de-energization of the load 110 may be suitably retarded from the change in the load status setting, and the load 110 may be turned either on or off at the same time that the load status setting is varied.

With the arrangement of the present invention, the load is turned on or off a certain interval of time after the load status setting has been shifted from the ON to the OFF condition or vice versa, so that any variation in the engine RPM due to energization or de-energization of the load can be reduced to a minimum. Consequently, the engine RPM can be controlled smoothly and efficiently witout any abrupt change leading to engine stalling.

Although a certain preferred embodment has been shown and described, it should be understood that many changes and modifications may be made therein without departing from the scope of the appended claims.

What is claimed:

1. A device for controlling engine RPM, comprising:

(a) means for setting a reference engine RPM;

(b) means for detecting an instantaneous engine RPM;

(c) means for computing a control signal based on the difference between the engine RPM detected by said detecting means and the reference engine RPM and for changing the engine RPM in response to the control signal;

(d) a load switch for detecting a load energization setting or a load de-energization setting of an engine load, wherein said means for setting is responsive to said load switch to increase said reference engine RPM when a load energization setting is detected and to decrease said reference engine RPM when a load de-energization setting is detected, said increase in the reference engine RPM lasting for the duration said load is operatively connected to the engine;

(e) a load compensator for adding a predetermined load compensation signal, dependent on the load setting detected by said load switch, to said control signal; and (f) load drive means responsive to said load switch detection and said instantaneous RPM for actuating or de-actuating said load in accordance with the status of said load switch, said drive means being operative to actuate or de-actuate said load when said instantaneous RPM is near the reference RPM set by said setting means upon switching of said load switch.

* * * * *